US005169334A

United States Patent [19]

Makita

[11] Patent Number: 5,169,334

[45] Date of Patent: Dec. 8, 1992

[54] SCREW-FASTENED ELECTRICAL CONNECTOR

[75] Inventor: Toshihiko Makita, Shizuoka, Japan

[73] Assignee: Yazaki Corporation, Tokyo, Japan

[21] Appl. No.: 779,917

[22] Filed: Oct. 21, 1991

[30] Foreign Application Priority Data

Oct. 30, 1990 [JP] Japan ..... 2-113095[U]

[51] Int. Cl.[5] ..... H01R 13/627

[52] U.S. Cl. ..... 439/362; 439/359

[58] Field of Search ..... 439/359-364

[56] References Cited

U.S. PATENT DOCUMENTS 4,284,315 8/1981 Williams ..... 439/362
4,317,160 2/1982 Tillson et al. ..... 439/359
4,997,305 3/1991 Yang ..... 439/362

*Primary Examiner*—Larry I. Schwartz

*Assistant Examiner*—Hien D. Vu

*Attorney, Agent, or Firm*—Sughrue, Mion, Zinn, Macpeak & Seas

[57] ABSTRACT

In a screw-fastened electrical connector, a plurality of cylindrical nuts are rotatably provided in a connector housing, a plurality of bolts are securely fixed to a mating connector housing, rotatory gears are secured to the cylindrical nuts and engaged with rotation direction changing gears secured to rotatory shafts at one end of each thereof, other rotation direction changing gears are secured to the shafts at the other ends thereof and engaged with driving gears secured to driving shafts, and the driving shafts are rotated in conjunction with a screw engaging portion. The cylindrical nuts are simultaneously rotated to be engaged with the bolts so that the housings are uniformly and smoothly fastened to each other.

10 Claims, 3 Drawing Sheets

SCREW-FASTENED ELECTRICAL CONNECTOR

BACKGROUND OF THE INVENTION

The present invention relates to a screw-fastened electrical connector in which a housing is provided with a plurality of screw means and another housing is provided with a plurality of screw reception means so that the screw means are engaged with the screw reception means to smoothly fasten the housings to each other.

FIG. 3 is a perspective exploded view of a conventional screw-fastened electrical connector including a male housing 26 made of a synthetic resin and shaped as a slender rectangular parallelepiped, and a female housing 30. The male housing 26 has a plurality of terminal chambers 28 disposed in mutually crossing rows to accommodate female terminals 27, and is provided with a fastening bolt 29 rotatably supported at the center of the male housing. A plurality of male terminals 31, which are inserted into the female terminals 27, are planted in the female housing 30. A fastening nut 32 is secured to the female housing 30 at the center thereof. When the male housing 26 is put in the female housing 30 and they are fastened to each other by screwing the bolt 29 into the nut 32, as shown in FIG. 4, a moment acts to the male housing across the longitudinal direction thereof due to a force for inserting the male terminals 31 into the female terminals 27 and increases gradually. For that reason, the male housing 26 warps to make the electrical connection of the terminals 27 and 31 imperfect. This is a problem.

SUMMARY OF THE INVENTION

The present invention was made in order to solve the problem mentioned above. Accordingly, it is an object of the present invention to provide a screw-fastened electrical connector which is a multi-terminal slender connector whose housings are prevented from warping when being fastened to each other, to keep the electrical connection of terminals good.

The screw-fastened electrical connector comprises: first and second connector housings to be mated with each other; a plurality of screw means rotatably provided in the first connector housing; a plurality of screw reception means secured to the second connector housing, and engaged with the screw means for fastening the first connector housing to the second connector housing; and rotation means provided in the first connector housing for simultaneously rotating the screw means so as to simultaneously engage the screw means with the screw reception means.

The rotation means preferably includes rotatory gears, each secured to the screw means; a rotation input shaft having an operating gear secured thereto and an operating portion for inputting a rotational torque; and gear means for transmitting the rotational torque from the operating gear to the rotatory gears.

The gears means preferably includes first rotatory shafts, each having first and second gears at both ends thereof, the first gears being engaged with the rotatory gears, respectively; and second rotatory shafts, each having third and fourth gears at both ends thereof, each of the second gears being engaged with the third gears and each of the fourth gears being engaged with the operating gear.

Each of the first, second third and fourth gears, the rotatory gears and the operating gear is preferably a bevel gear. The operating portion is preferably a bolt head projected outward from the first connector housing. The screw means preferably includes a plurality of cylindrical nuts rotatably provided in the first connector housing, disposed at four corners of the first connector housing and prevented from being moved in an axial direction thereof.

DETAILED DESCRIPTION OF THE PREFERRED EMBODIMENTS

An embodiment of the present invention is hereafter described in detail with reference to the drawings attached hereto.

Figure 1:
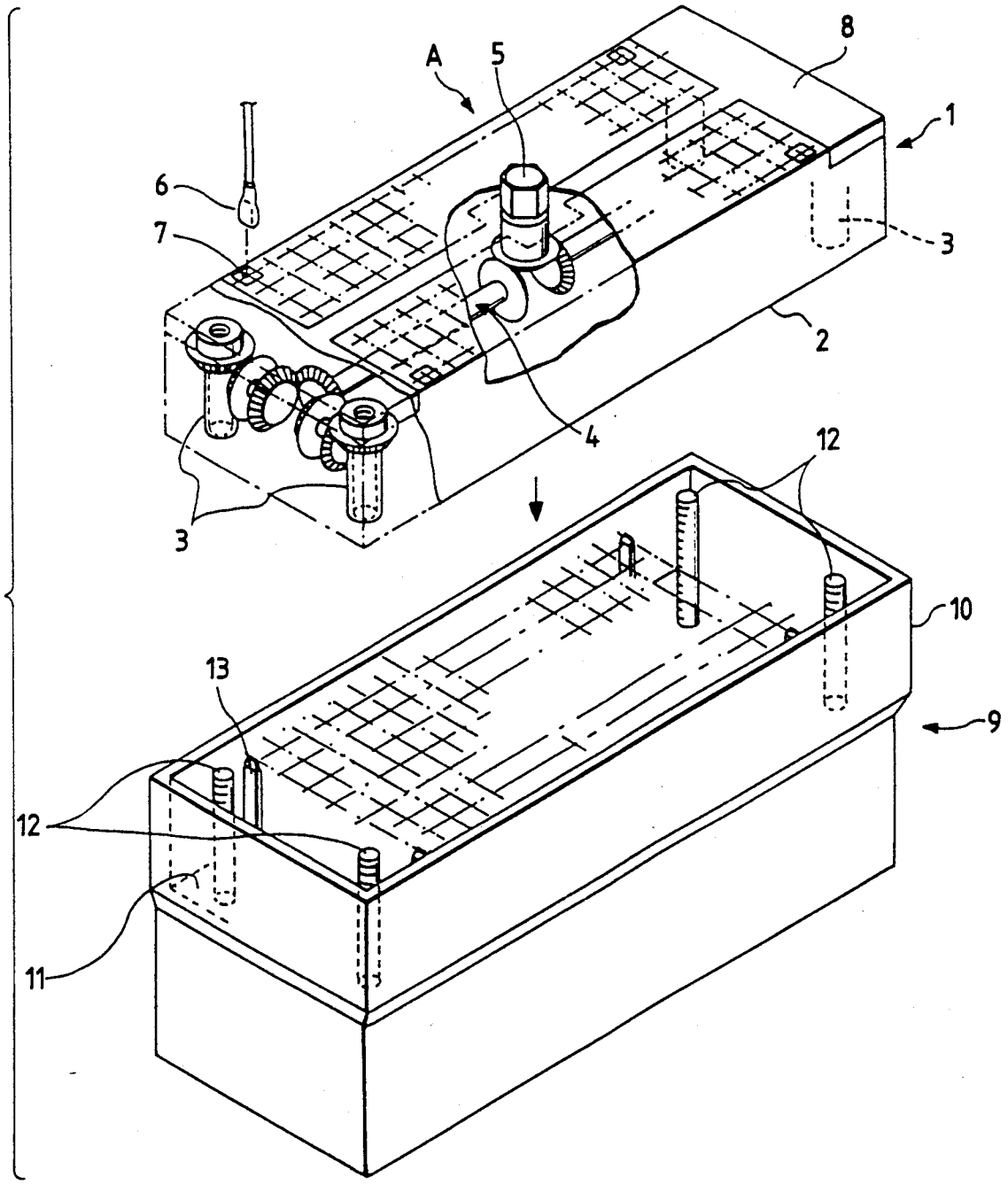
FIG. 1 is a perspective exploded view of a screw-fastened electrical connector according to an embodiment of the present invention.

FIG. 1 shows a screw-fastened electrical connector which is the embodiment and includes a male housing 1 and a female housing 9. The male housing 1 includes a body 2 made of a synthetic resin and shaped as a slender rectangular parallelepiped, and a cover 8 made of a synthetic resin and shaped as H. The male housing 1 is provided with cylindrical nuts 3 disposed in the body of the housing at the four corners thereof, and a drive mechanism 4 which has an operating bolt head 5 and is for rotating the nuts. The bolt head 5 projects outside the body 2 of the male housing 1. The body 2 has a plurality of terminal chambers 7 except at the nuts 3, the drive mechanism 4 and the bolt head 5. A plurality of female terminals 6 are accommodated in the terminal chambers 7. The cover 8 is fitted on the body 2, over the drive mechanism 4. The female housing 9 includes a body 10 made of a synthetic resin, and is provided with bolts 12 secured to the inside bottom 11 of the body at the four corners thereof, and a plurality of male terminals 13 except at the bolts. The male terminals 13 are inserted into the female terminals 6 so as to be electrically connected thereto.

Figure 2C:
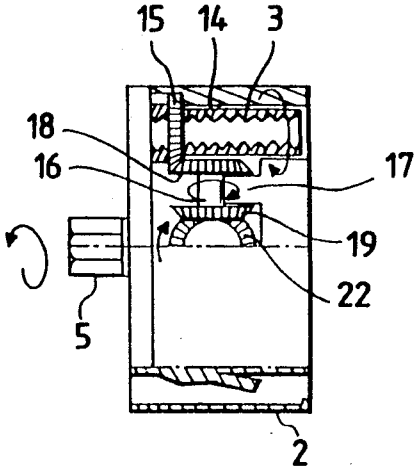
FIG. 2C is a sectional view of the male housing taken along a line C—C shown in FIG. 2A.
Figure 2A:
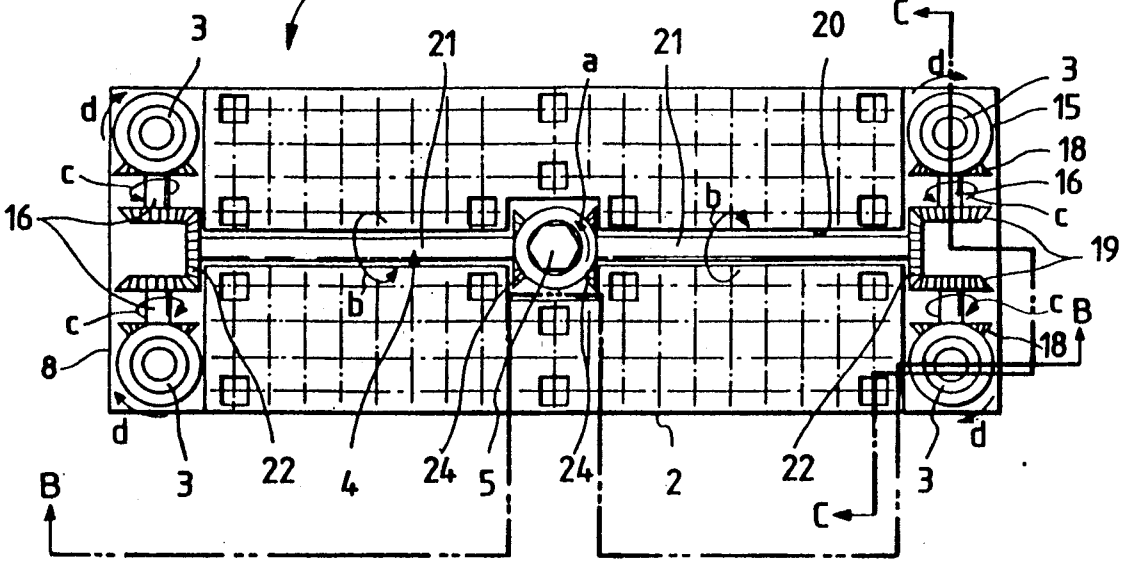
FIG. 2A is a plan view of a male housing of the connector, seen along an arrow A shown in FIG. 1.
Figure 2B:
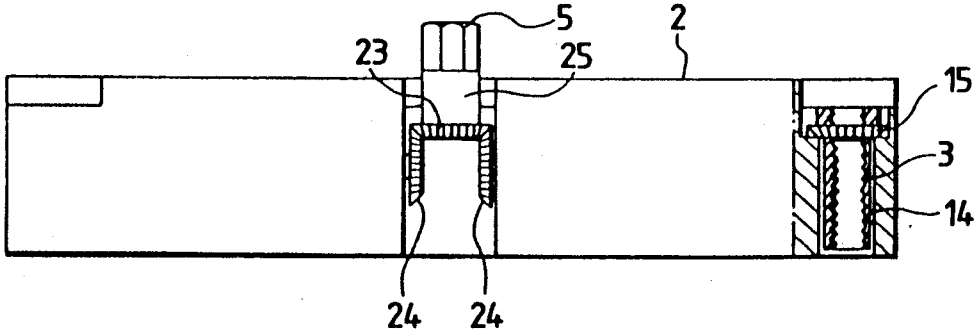
FIG. 2B is a sectional view of the male housing taken along a line B—B shown in FIG. 2A.
Figure 3:
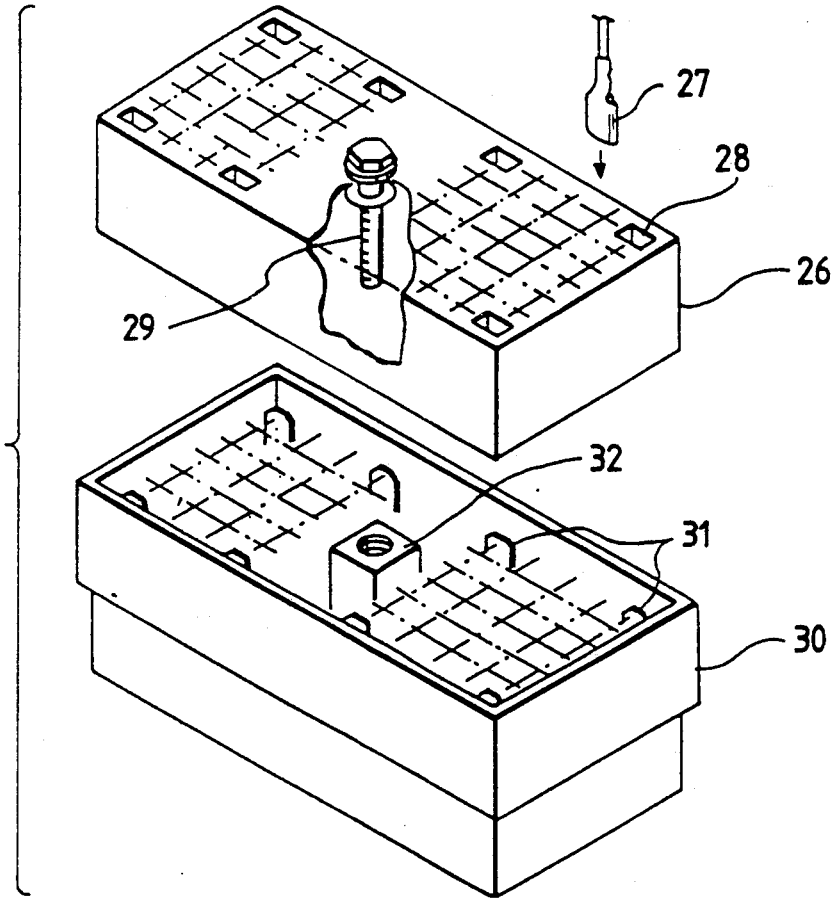
FIG. 3 PRIOR ART
FIG. 3 is a perspective exploded view of a conventional screw-fastened electrical connector.
Figure 4:
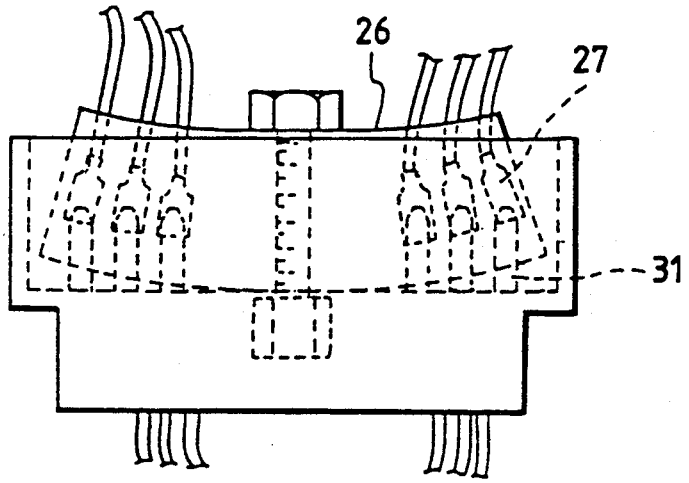
FIG. 4 PRIOR ART
FIG. 4 is a front view of the conventional connector.

The drive mechanism 4 is described in detail with reference to FIGS. 2A, 2B and 2C from now on. FIG. 2A shows the male housing 1 in the state that the cover 8 is removed from the housing. The drive mechanism 4 includes the bolt head 5, rotatory bevel gears 15, 18, 19, 22, 23 and 24, and rotatory shafts 16, 21 and 25. The rotatory bevel gears 15 are secured face-down to the upper portions of the cylindrical nuts 3 rotatably supported in through holes 14 provided in the body of the male housing 1 at the four corners thereof. The rotatory shafts 16 are supported by bearing portions 17, and extend in the direction of the width of the body 2 of the male housing 1. The bevel gears 18 and 19 for changing the direction of the rotation of the drive mechanism 4 are secured to the rotatory shafts 16 at both the ends thereof. The bevel gears 18 secured to the shafts 16 at the outer ends thereof are engaged with the bevel gears 15. The rotatory shafts 21 are driving shafts extending in slender grooves 20 provided in the central portion of of the body 2 of the male housing 1 and extending in the longitudinal direction thereof. The bevel gears 22 are driving gears secured to the driving shafts 21 at the outer ends thereof and engaged with the bevel gears 19 secured to the shafts 16 at the inner ends thereof and facing each other. The rotatory shaft 25 is an operating shaft provided at the center of the body 2 of the male housing 1 and has the operating bolt head 5 projecting outside the body. The bevel gear 23 is an operating gear secured to the operating shaft 25 at the lower end thereof and engaged with the driving bevel gears 24 secured to the driving shafts 21 at the inner ends thereof and facing each other. When the male housing 1 is put in the female housing 9 and the operating bolt head 5 of the operating shafts 25 is then turned counterclockwise (as viewed from the respective sides) as shown by an arrow a In FIG. 2A, the driving shafts 21 are rotated counterclockwise (as viewed from the respective sides) as shown by arrows b, through the operating bevel gear 23 and the driving bevel gears 24, so that the rotatory shafts 16 are rotated counterclockwise (as viewed from the respective sides) as shown by arrow c, through the driving bevel gears 22 and the rotation direction changing bevel gears 19. As a result, the cylindrical nuts 3 are rotated clockwise (as viewed from above) as shown by arrows d in FIG. 2A, through the rotatory shafts 16 and the rotation direction changing bevel gears 18 and 15, so that the nuts are engaged with the bolts 12 of the female housing 9 to uniformly fasten the male and the female housings 1 and 9 to each other. The male and the female housings 1 and 9 can thus be smoothly fastened to each other without causing the housings to warp. To unfasten the housings 1 and 9 from each other, the operating bolt head 5 is turned clockwise as viewed from above.

The present invention is not confined to the above-described embodiment, but may be embodied or practiced in other various ways without departing from the spirit and scope of the invention. For example, two nuts may be provided in the male housing 1 at both the ends thereof or two or four nuts may be provided in the male housing at the intermediate portion thereof, instead of providing the nuts in the male housing at the four corners thereof. Besides, the operating bolt head 5 may be provided on one of the four nuts 3 instead of being provided at the center of the male housing 1.

According to the present invention, when the housings of a connector are to be fastened to each other, the screw engaging portion provided in one of the housings is turned to rotate the driving shafts so that the rotatory shafts are rotated through the driving gears and the rotation direction changing gears. As a result, a plurality of screw reception means provided in the housing are simultaneously rotated to be engaged with the plurality of screw means so that the housings are uniformly and smoothly fastened to each other. For that reason, the housings do not undergo deformation such as warp. Thus, the housings are surely fitted to each other to keep electrical connection of the terminals good.

What is claimed is:

1. A screw-fastened electrical connector comprising:

first and second connector housings to be mated with each other;

a plurality of screw means rotatably provided in said first connector housing;

a plurality of screw reception means secured to said second connector housing, and engageable with said screw means for fastening said first connector housing to said second connector housing; and rotation means provided in said first connector housing for simultaneously rotating said screw means so as to simultaneously engage said screw means with said screw reception means wherein said rotation means includes:

rotary gears secured to said screw means, respectively;

a rotation input shaft having an operating gear secured thereto and an operating portion for inputting a rotational torque; and gear means for transmitting said rotational torque from said operating gear to said rotary gears.

2. The connector according to claim 1, wherein said operating portion is a bolt head projected outward from said first connector housing.

3. The connector according to claim 1, wherein said first connector housing is formed with a recess portion substantially shaped as H, said rotation means being accommodated in and supported by said recess portion.

4. The connector according to claim 1, wherein said gears means includes:

first rotary shafts, each having first and second gears at both ends thereof, said first gears being engaged with said rotary gears, respectively; and second rotary shafts, each having third and fourth gears at both ends thereof, each of said second gears being engaged with said third gears and each of said fourth gears being engaged with said operating gear.

5. The connector according to claim 4, wherein each of said first, second third and fourth gears, said rotatory gears and said operating gear is a bevel gear.

6. The connector according to claim 1, wherein said screw means include a plurality of cylindrical nuts rotatably provided in said first connector housing and prevented from being moved in an axial direction thereof.

7. The connector according to claim 6, wherein said screw means are disposed at four corners of said first connector housing.

8. The connector according to claim 6, wherein said first connector housing is formed with a recess portion substantially shaped as H, said rotation means being accommodated in and supported by said recess portion.

9. A screw-fastened electrical connector comprising:

first and second connector housings to be mated with each other;

a plurality of screw means rotatably provided in said first connector housing;

a plurality of screw reception means secured to said second connector housing, and engageable with said screw means for fastening said first connector housing to said second connector housing; and rotation means provided in said first connector housing for simultaneously rotating said screw means so as to simultaneously engage said screw means with said screw reception means, wherein said screw means are disposed at four corners of said first connector housing.

10. A screw-fastened electrical connector in which two connector housings are mated together and fastened by utilizing a threading engagement, said connector comprising:

a first connector housing having a plurality of screw means rotatable relative thereto;

a second connector housing having screw reception means adapted to be engaged with said screw means to fasten said housings to each other;

rotary gears secured to said screw means;

driving shafts having driving gears secured thereto;

rotary shafts having first rotation direction changing gears respectively secured to one end of said rotary shafts and having second rotation direction changing gears respectively secured to the other ends of said rotary shafts, said first rotation direction changing gears being meshed with said rotary gears and said second rotation direction changing gears being meshed with said driving gears; and a screw engagement manipulation portion for rotating said driving shafts in conjunction with a rotation thereof.

* * * * *